United States Patent [19]

Henrich et al.

[11] 3,945,680

[45] Mar. 23, 1976

[54] DRUM COAL CUTTING MACHINE HAVING A ROLLER CRUSHER

[75] Inventors: Friedhelm Henrich, Bochum-Weitmar; Willy Lanfermann, Bochum, both of Germany

[73] Assignee: Gebr. Eickhoff, Maschinenfabrik und Eisengiesserei m.b.H., Germany

[22] Filed: Nov. 14, 1974

[21] Appl. No.: 523,734

[30] Foreign Application Priority Data

| | | |
|---|---|---|
| Nov. 17, 1973 | Germany | 2357559 |
| Mar. 1, 1974 | Germany | 2409834 |

[52] U.S. Cl. ..... 299/43; 241/27; 299/18

[51] Int. Cl.[2] ..... E21C 35/20

[58] Field of Search ..... 299/32, 34, 43–53; 241/27, 189

[56] References Cited

UNITED STATES PATENTS

| | | | |
|---|---|---|---|
| 3,061,210 | 10/1962 | Schaeffer | 241/27 X |

FOREIGN PATENTS OR APPLICATIONS

| | | | |
|---|---|---|---|
| 43,895 | 11/1960 | Poland | 299/51 |
| 1,223,786 | 9/1966 | Germany | 299/45 |

*Primary Examiner*—Ernest R. Purser

*Attorney, Agent, or Firm*—Brown, Murray, Flick & Peckman

[57] ABSTRACT

A roller crusher is carried by a coal cutting mining machine which is, in turn, carried by a gantry for movement along the frame of a longwall face conveyor. The roller crusher is attached to the coal cutting machine by a U-shaped frame having hinge pins for pivotal movement thereof about a horizontal axis at the end of the machine which faces toward the oncoming stream of coal on the conveyor. The U-shaped frame supports a drive motor that is, in turn, coupled by a gear drive to the roller crusher. A piston and cylinder assembly is controlled to adjustably position the U-shaped frame and thereby the roller. The mining machine has support arms that are pivotal about horizontal axes and carry coal cutting drums to project into the working face of the mine.

12 Claims, 10 Drawing Figures

DRUM COAL CUTTING MACHINE HAVING A ROLLER CRUSHER

BACKGROUND OF THE INVENTION

This invention relates to a coal cutting machine carried by a gantry which is adapted to travel along the bed or frame of a longwall face conveyor. More particularly, the present invention relates to a coal mining machine having one or more coal cutting drums which project outwardly into the working face of the mine together with a roller crusher for subdividing lumps of coal while carried by a conveyor, wherein both the cutting drums and the roller crusher are supported for pivotal movement about horizontal axes.

In coal mining operations, the raw coal released by the cutting tools of a drum-type mining machine is loaded onto a conveyor partly by screw-shaped driving surfaces located at the periphery of the cutting drums and partly by guide plates located behind the cutting drums. However, as the mining machine moves along the longwall face of the mine, it has been discovered that portions of the longwall face of the mine frequently become detached and fall directly onto the conveyor. The detached and falling coal stems from cave-ins or "breakbacks" of the coal face and usually presents relatively large lumps of coal.

As a general rule, the mining machine with drum-type cutters travels along the face of the mine at a speed which is only a fraction of the operating speed of the longwall face conveyor. Typically, for example, an average speed for a mining machine is about 0.1 meter per second while a speed of about 0.3 meter per second is a quite common conveyor speed for a scraper chain-type conveyor. Thus, during times when the mining machine travels in either direction, and when it is stationary, there is an appreciable relative velocity between a gantry which supports the mining machine above a longwall face conveyor and the material transported by the conveyor. Now since the raw coal produced by cave-ins or breakbacks can reach the conveyor in the form of large lumps, it frequently occurs that these lumps are larger than the free space which exists between the conveyor and the gantry supporting the mining machine above the conveyor. These lumps of coal can and frequently do lead to blockages and other operating difficulties, particularly if they cannot pass through the portal opening of the gantry.

It is already known in the art to mount roller crushers on drum-type mining machines as, for example, in an associated relation with a support arm which carries one of the cutting drums of the mining machine. In this known arrangement, the roller crusher is actually mounted on the support arm at the side thereof opposite to the location of the cutting drum and parallel to the rotational axis thereof. The roller crusher is driven by the same drive system which rotates the cutting drum. This drive system is located within the support arm that carries both the cutting drum and the roller crusher.

It is another known arrangement to mount the shaft of a roller crusher directly in the frame of the mining machine and couple this shaft to the drive which rotates the cutting drum. In both of the above-known arrangements, the position or vertical height as well as the rotational speed of the roller crushers are fixed and cannot be matched to the actual operating conditions.

It is impossible to independently position or rotatably control the roller crusher.

SUMMARY OF THE INVENTION

It is an object of the present invention to operatively locate a roller crusher on the side of a mining machine while supported by a gantry for movement along the mine face such that the roller crusher faces toward the oncoming flow of coal being transported by a conveyor so as to reduce the size of such oncoming material for free passage thereof beneath the mining machine.

In accordance with the present invention, there is provided the combination of a conveyor having a support frame adapted to rest upon the footwall of a coal mine and extending in a direction parallel to the working face thereof, of a coal mining apparatus comprising a gantry adapted to travel along the conveyor frame, a coal cutting machine carried by the gantry, a support arm pivotally attached to the mining machine for movement about a horizontal axis, a cutter head mounted on the support arm for projecting into the working face of the mine, and a roller crusher carried by the coal cutting machine for movement about a horizontal axis at the end of the gantry which faces toward the oncoming stream of coal carried by the conveyor. The present invention further provides that a drive motor for the roller crusher is mounted on a support arm structure for swinging movement therewith about a horizontal axis and a reduction drive gear operatively coupled between the drive motor and the crusher roller for rotating the latter.

According to the preferred form of the present invention, the aforesaid support arm structure takes the form of a U-shaped frame which is constructed and arranged so as to support the drive motor between spaced-apart arms thereof which are attached at their free ends to the mining machine for swinging movement about a horizontal axis. A piston and cylinder assembly is operatively coupled between the mining machine and the U-shaped frame for pivotally positioning the support arm and thereby the crusher roller.

According to the roller crusher arrangement of the present invention, it is possible to achieve a satisfactory reduction to the size of large lumps of raw coal while they are conveyed by the longwall face conveyor. As may be needed or deemed necessary by an operator of the mining machine, the roller crusher can be instantly and appropriately lowered toward the conveyor especially when large lumps of coal are carried toward the mining machine. In a similar way, the roller crusher can be raised to a suitable or desired height so that the lumps of coal can travel into the path of the rotating tool elements of the roller crusher for breaking down or subdividing these lumps of coal.

It is an especially important and significant feature of the present invention that the roller crusher is provided with a separate drive system so that it can be put into operation even though the drum cutters of the mining machine are not operating. The employment of a U-shaped frame to form a support arm for the roller crusher has the particularly desirable feature of protecting the drive motor and the position control piston and cylinder assembly when they are mounted in the space between the arm members thereof. This arrangement of parts also provides a robust and compact construction for the mining machine.

Appropriately, a pressure and suction valve block is provided in the lines which connect together the two sides of the piston in the aforesaid piston and cylinder assembly. The valve block is operatively arranged in the pressure and suction lines so as to insure a resilient support for the roller crusher while it is located in a desired operating position but at the same time continuously provides that the roller crusher can swing upwardly should it become overloaded by excessively large lumps of coal which otherwise may be forced under it by the driving strips or flight attachments of the conveyor system. Naturally, should the roller crusher be moved to a higher operating position, then the roller crusher must be returned to its lower and normal working position by an operator.

It is a further objective of the present invention to provide a control device to resiliently position the roller crusher in its desired operating position whereby after an overload condition caused by oversized lumps of coal has been alleviated, the roller crusher is again automatically returned to its normal operating position.

To achieve this object, the present invention provides that the chamber of a reversibly-operating piston and cylinder assembly or its feed lines which is acted upon when the roller crusher is lowered, is provided with two pressure switches, one of which responds to a maximum fluid pressure while the other responds to a minimum fluid pressure. The arrangement being such that between the piston and cylinder assembly and the pump for the fluid medium, there is incorporated a controllably valve which moves in response to a signal from the low pressure switch into a position which connects the cylinder chamber of the piston and cylinder assembly with the pump. This valve also moves in response to a signal from the switch responsive to the maximum fluid pressure to connect the cylinder chamber with a sump. As a result, in the event of an overload produced by large lumps of coal, the roller crusher is withdrawn upwardly and then returned from its upward position to its original position by the pressure from the pump when the excessive fluid pressure has returned to a valve at which the low pressure switch is responsive. By this means, therefore, it is possible to actuate the flow valve either electrically or by means of the pressure medium.

When a coal extracting machine is installed for operation at a location which is endangered by firedamp, it is preferred that the flow-valve for controlling the operation of the piston and cylinder assembly is actuated by pressure medium which is controlled by a magnetic solenoid valve located in a pressure-tight chamber in the compartment containing the hydraulic system. The solenoid valve is actuated by the two pressure sensor switches.

An adjustable throttle valve discharges the fluid medium to a sump when the roller crusher is lowered. This valve is installed in the feed line of the other operating side of the piston and cylinder assembly in order to regulate the downward movement of the roller crusher and to prevent the structure or other foreign materials which are supported by the piston and cylinder assembly from determining the speed of the downward movement thereof. The throttle valve limits the amount of liquid which can be discharged into the sump per unit of time and thus controls the movement of the piston to determine the lowering speed and the required operating position of the roller crusher.

It is a further characteristic feature of the present invention to provide an adjustable stop to limit in an accurately controlled manner the lift or operating stroke of the piston and cylinder assembly according to the height of the portal opening of the gantry.

The drive motor for the roller crusher is preferably mounted by an end face to the inner face of crossbars forming the U-shaped frame such that the drive shaft of the motor is coupled directly to a worm gear in a gear drive that is mounted on the other side of the crossbar. The drive housing of this drive encloses the worm coupled to the drive motor and a worm wheel in mesh therewith and coaxially mounted between two sections forming the roller crusher which enclose the sides of the drive housing. The drive housing is made of two halves which are bolted together with a divide line lying in a plane which passes through the worm gear and which runs perpendicular to the axis of the roller crusher. The arrangement being such that the divided housings are each conveniently attached to a hood which can be removed from about the actual roller crusher.

The drive housing has cooling channels which surround the worm shaft and extend about the lower portion of the housing so that cooling fluid from the drive motor flowing through these channels will improve the removal of heat produced by the energy losses within the worm gear drive. It is preferred to provide a cooling channel in each of the divided housing parts with the two channels connected together by a common passageway. Spray nozzles communicate with the cooling channels to discharge the cooling liquid as a spray in the direction of the working region of the roller crusher.

It is desired to attach a mounting plate to the front of the mining machine and equip this plate with a plurality of lugs to support pivot pins which form the pivot axes for the support arms of the U-shaped frame and for mounting the piston and cylinder assembly employed to position the roller crusher. Such a mounting plate has the advantage of facilitating the attachment of a roller crusher to existing mining machines which are already in use. By employing this mounting plate, an additional advantage is realized whereby a mining machine can be equipped with a roller crusher having its rotational axis arranged either vertically or horizontally. When the roller crusher is mounted with its rotational axis extending in the vertical direction, the lower section of the roller crusher must also be provided with an end face cutting tool.

In order to employ a roller crusher in accordance with the teachings of the invention in combination with low profile mining machines, such as are installed in low mine seams, the position control piston and cylinder assembly can be mounted above or below the U-shaped frame as desired. In a similar manner, the pivotal mounting for the U-shaped frame as well as the piston and cylinder assembly may be attached by appropriately positioned lugs. When the position control piston and cylinder assembly lies below the support arms of the frame, this cylinder assembly is located entirely within the profile of the mining machine and therefore no additional space is required which may be otherwise necessary should this piston and cylinder assembly be mounted above the support arms.

These features and advantages of the present invention as well as others will be more readily understood when the following description is read in light of the accompanying drawings, in which.

Figure 1:
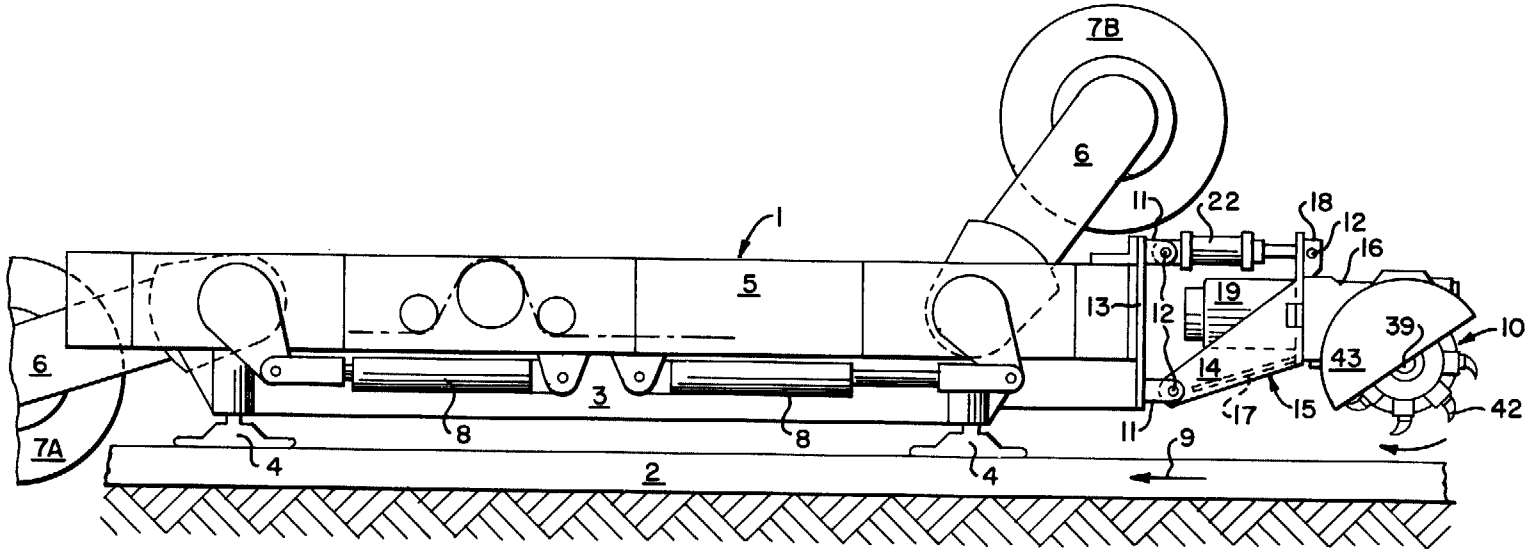
FIG. 1 is an elevational view of a drum-type coal cutting machine which embodies, according to the present invention, a roller crusher for rotation about a horizontal axis.
Figure 2:
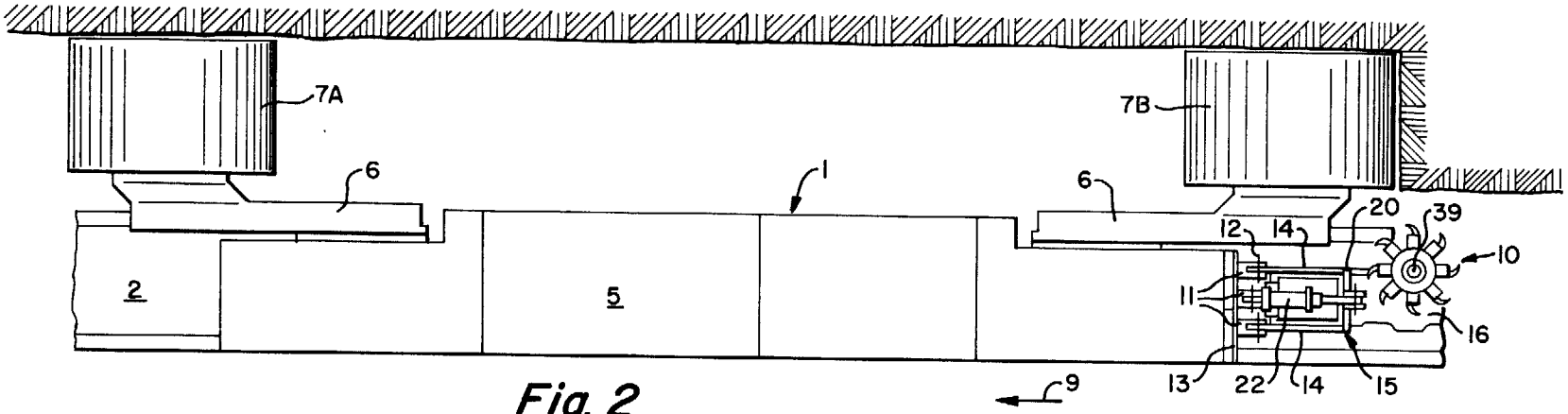
FIG. 2 is a plan view of a drum-type coal cutting machine embodying, according to the present invention, a roller crusher for rotation about a vertical axis.

FIG. 1 illustrates a drum-type coal cutting machine 1 for extracting coal from a mine face during which it travels in a direction parallel with and upon a longwall face conveyor 2. The drum-type cutting machine essentially includes a gantry 3 which is supported by pressure pads or skids 4 for movement along the longwall face conveyor 2. The gantry 3 supports a mining machine body 5 which, in turn, carries support arms 6. Extending from one side of these arms are cutting drums 7A and 7B which are rotatably supported by bearings carried in the support arms. The cutting drums are driven in a well known manner and their position is controlled by hydraulic actuators 8. The longwall face conveyor 2 continuously transports the coal obtained in the mining operation in the direction of the arrow 9 as illustrated in FIGS. 1 and 2. The coal liberated by the drum 7B from the mine face must always be carried away by the conveyor through the portal of the gantry 3 which lies below and carries the machine body 5. A roller crusher 10 is provided according to the present invention, to break down large lumps of coal while transported by the conveyor so as to prevent blockage by such lumps of coal at the portal opening formed by the gantry. The present invention provides that the roller crusher 10 is attached to the front end of the drum cutting mining machine 1 which end faces toward the oncoming stream of coal transported by the conveyor.

Figure 3:
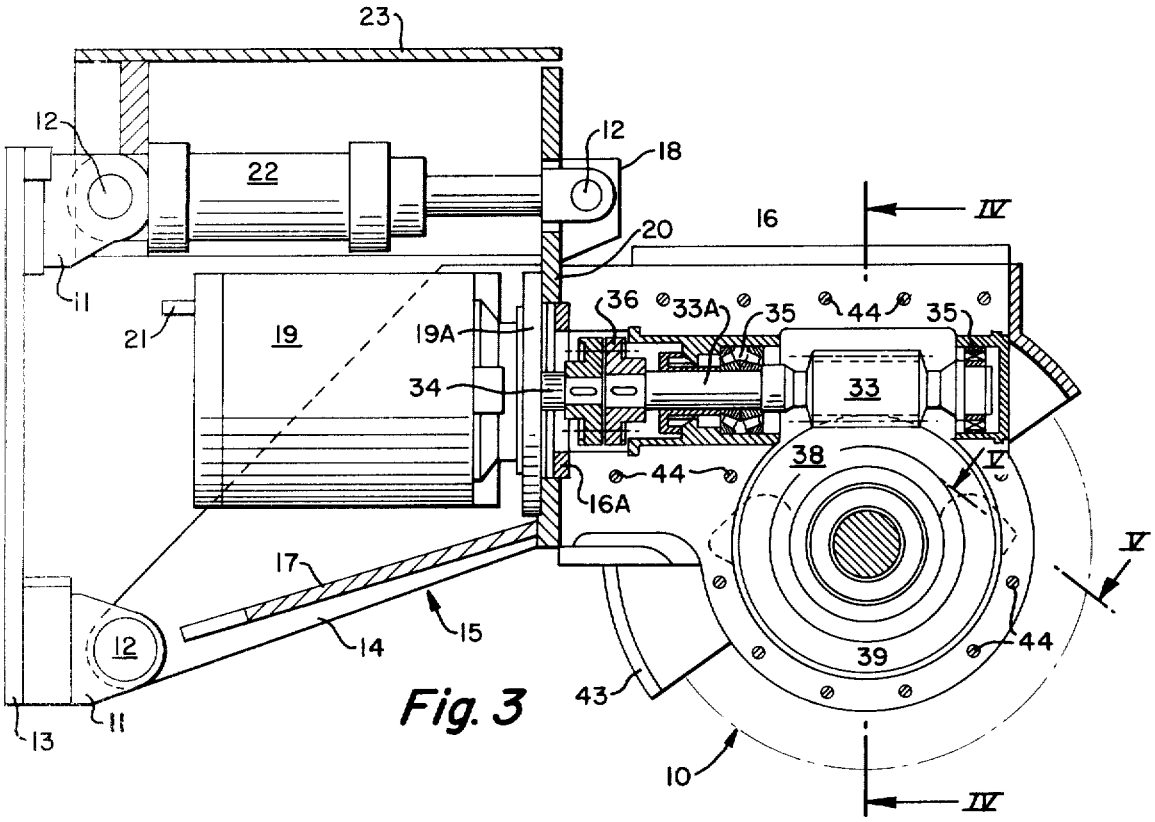
FIG. 3 is a partial sectional view taken along the longitudinal center of the mining machine shown in FIG. 1 and specifically along line III—III of FIG. 4.
Figure 4:
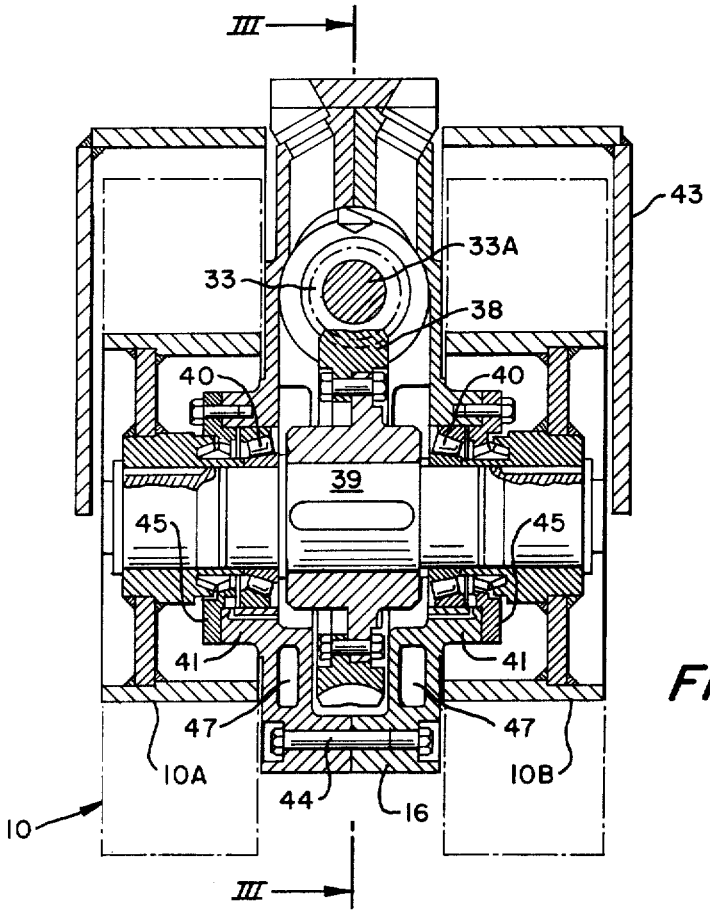
FIG. 4 is a sectional view taken along line IV—IV of FIG. 3.

FIGS. 1–4 illustrate the details of the construction of the roller crusher 10. Attached by bolts or the like to machine body 5 is a plate 13 which, in turn, carries lugs 11 for receiving pivot pins 12 which are passed through openings in the ends of support arms 14 which form part of a U-shaped frame 15. The support arms 14 of the U-shaped frame 15 also carry a gear housing 16 that is divided into two gear housing parts that are held together by bolts 44 as shown in FIGS. 3 and 4. The U-shaped frame 15 forms a protective housing for a drive motor 19 which is attached by a motor flange 19A to a crosspiece 20 that interconnects the arms 14 of the U-shaped frame 15. The arms 14 are reinforced by ribs 17. A hood-like guard 43 partly encloses the top peripheral part of the roller crusher 10. A flexible pipeline, not shown, continuously supplies cooling liquid from the drum cutting mining machine 1 to the drive motor 19 by way of an inlet pipe 21 shown only in FIG. 3. A piston and cylinder assembly 22 is attached at its rod end by a pivot pin 12 to a lug 18 that is carried by the crosspiece 20 of the U-shaped frame 15. The cylinder body of the piston and cylinder assembly 22 is attached by a pivot pin 12 to the lug 11 carried by the plate 13. As shown in FIG. 3, a hood 23 is attached to and forms an upper enclosure for the space between the arms 14 to protect both the piston and cylinder assembly 22 as well as the motor 19. If necessary or desired, the piston and cylinder assembly 22 may be located below the drive motor 19 as may be appropriate to reduce the overall height of the mining machine. For this purpose, an additional pair of lugs 11, not shown, may be conveniently attached to the plate 13 between the lugs for the support arms 14 and in addition a lug similar to lug 18 can be readily attached to the lower part of the crosspiece 20.

As best illustrated in FIG. 3, the gear housing 16 includes a mounting flange 16A for mounting the housing to the crosspiece 20 of the U-shaped frame. The gear housing 16 includes reduction gearing which takes the form of a worm gear 33 carried on a worm shaft 33A which is coaxially arranged with the motor shaft 34 of the drive motor 19. The worm shaft 33A is rotatably supported by bearings 35 in the housing 16. A coupling 36 is used to interconnect the worm shaft with the motor shaft.

According to the arrangement of parts illustrated in FIG. 1 the roller crusher 10 is attached to the mining machine so that the rotational axis of the roller crusher extends in the horizontal direction. This arrangement of parts is provided by attaching the gear housing 16 by its mounting flange to the crosspiece 20 of the U-shaped frame 15 whereby with the gear housing so positioned, a worm wheel 38 lies below the worm 33 in meshing engagement therewith for rotation of the worm wheel about a horizontal axis extending along shaft 39. As best illustrated in FIG. 4, the shaft 39 is rotatably supported by bearings 40 which are mounted in side bosses 41 of the gear housing 16. Shaft 39 is held in position by retainer plates 45 that are bolted to the bosses 41 and include annular collars which engage the outer races of the roller bearings 40. The ends of the shaft 39 are extended to project from the gear housing 16 and carry roller crusher sections 10A and 10B forming the roller crusher 10. The roller crusher as illustrated in FIG. 1 includes crusher tools 42 that are tooth-like members which are rotated in the direction of the arrow to facilitate movement of the coal by the conveyor.

Figure 5:
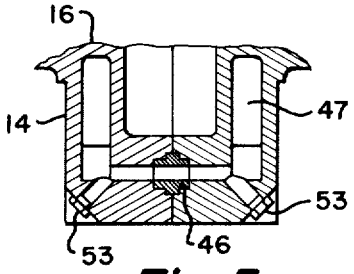
FIG. 5 is a sectional view taken along line V—V of FIG. 3.
Figure 6:
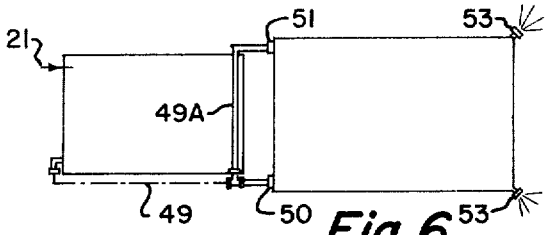
FIGS. 6 and 7 are schematic illustrations of coolant feed lines for the roller crusher according to the present invention.
Figure 7:
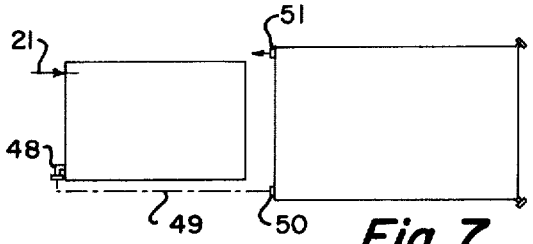

As previously described, the gear housing 16 is made in two parts with the divide line in a longitudinal direction of the housing and lying in a vertical plane passing through the worm shaft 33A. As shown by FIG. 2, the gear housing 16 is attached to the crosspiece 20 of the U-shaped frame in a manner whereby the worm wheel 38 and the sections 10A and 10B of the roller crusher 10 rotate about a vertical axis as defined by the position of the shaft 39. However, in this case, the end face of the lower section, not shown, of the roller crusher must also be provided with crushing tool elements 42. As best shown by FIG. 5, the two halves of the gear housing 16 receive a continuous supply of cooling water which flows through cooling channels 47 which are connected together by a passageway and pipe 46. This cooling water extracts the heat produced due to energy losses of the reduction gearing. As illustrated schematically in FIG. 7, cooling water enters the drive motor 19 by pipe 21. Water is discharged from the motor by outlet pipe 48 and the pipeline 49 conducts the water to the gear housing 16 where it enters through pipe fitting 50 to one of the cooling channels in the housing halves. The water exits from the other housing half at pipe fitting 51. Alternatively, as illustrated in FIG. 6, it is also possible to feed the cooling water through a header pipe 49A into both halves of the gear housing by connecting this header pipe to fittings 50 and 51. In this embodiment, the cooling water is discharged from the gear housing 16 through nozzles 53 which, as shown in FIG. 5, are arranged to direct the stream of cooling water onto the sections 10A and 10B of the roller crusher.

Figure 8:
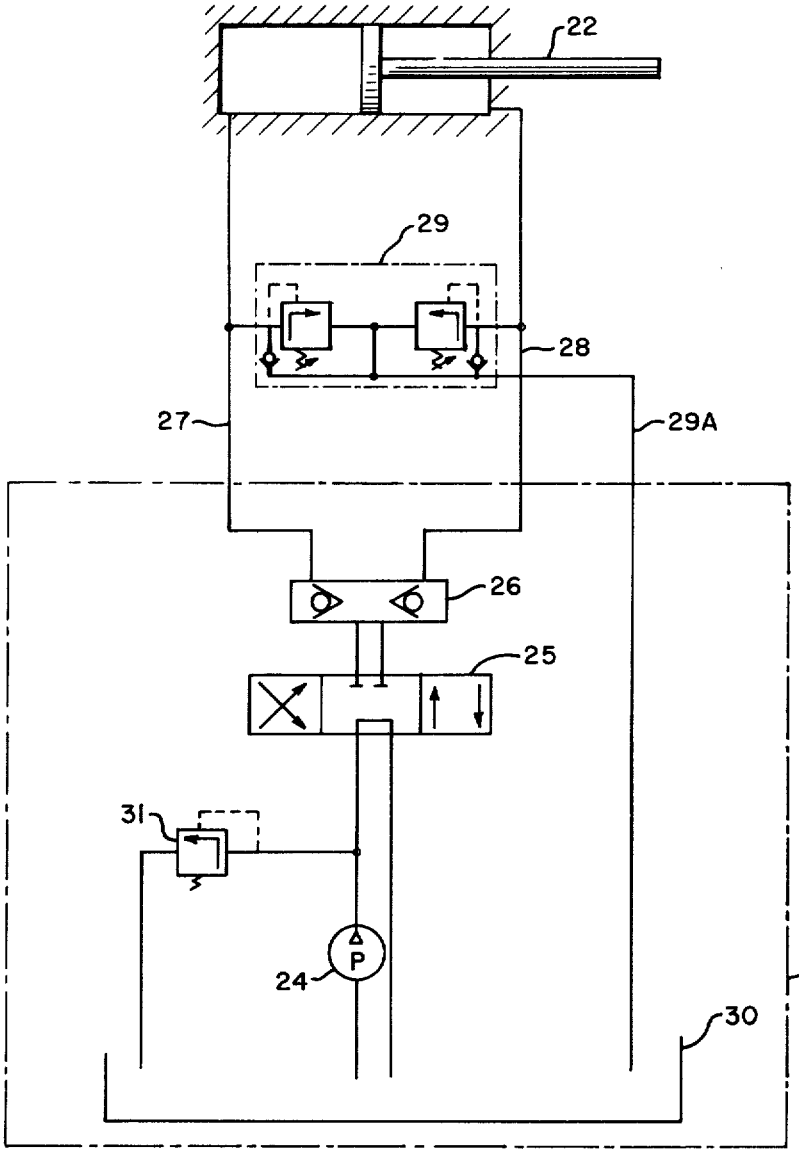
FIG. 8 is a schematic diagram of a hydraulic control system for position control of the roller crusher of the present invention.

As shown schematically in FIG. 8, the piston and cylinder assembly 22 is supplied with hydraulic fluid under pressure by a pump 24 which is located within the drum cutting mining machine 1. Hydraulic fluid delivered from a pump 24 is controlled by a throttle valve 25 that is connected by separate lines to a twin-check valve 26 from where pipelines 27 and 28 conduct the hydraulic fluid to the piston side and rod side respectively of the piston and cylinder assembly 22. The lines 27 and 28 are connected to a pressure and suction valve block 29 through which the hydraulic fluid can flow from one side of the piston to the other. Line 29A conducts the hydraulic fluid discharged from the valve block 29 to a sump 30. This line also delivers fluid to the valve block 29 as may be needed during the operation of the piston and cylinder assembly according to the present invention. A pressure limiting valve 31 is connected in the hydraulic fluid supply line from the pump 24. The hydraulic fluid delivered by pump 24 is limited by pressure limiting valve 31 and delivered to the throttle valve 25 which, when in the position shown, is returned directly to the sump 30 which corresponds to a blocked and idle position of the piston and cylinder assembly 22. When the throttle valve 25 is moved to the left as one views FIG. 8, the hydraulic fluid is delivered through the check valve 26 to line 27 and passed into the piston side of the piston and cylinder assembly 22, thus extending the piston out of the cylinder. At the same time fluid is conducted by line 28 from the piston and cylinder assembly through the suction valve block 29 and passed to the sump 30 via line 29A. When the throttle valve 25 is moved to the right as one views FIG. 8, hydraulic fluid is delivered by line 28 to the rod end of the piston and cylinder assembly, forcing the piston to retract within the cylinder. As this occurs, fluid is expelled into line 27 and discharged through the valve block 29 via line 29A to the sump 30.

Figure 9:
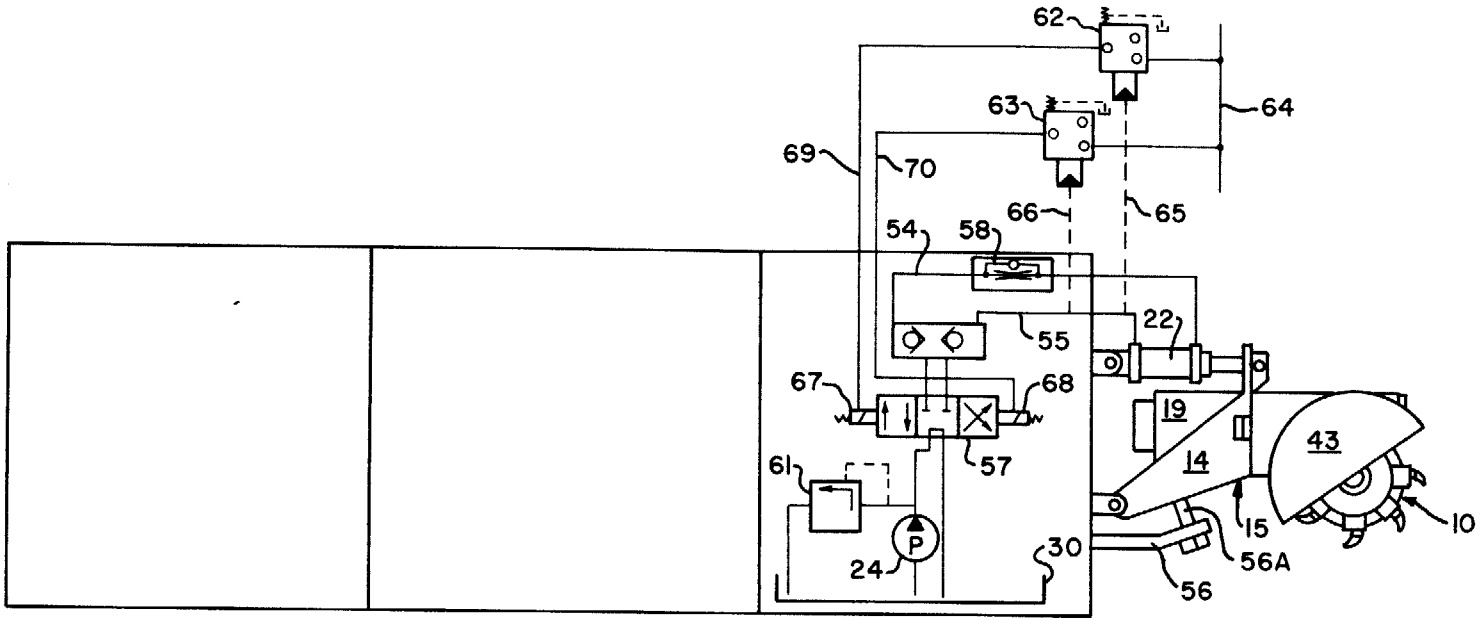
FIG. 9 is a schematic diagram of a modified hydraulic control system for position control of the roller crusher of the present invention.

In FIG. 9, there is illustrated an adjustable stop 56 to limit the lowermost position of the roller crusher in relation to the portal opening in the gantry 3 of the mining machine 1 and the conveyor 2. The adjustable stop 56 includes a threaded stop bolt 56A with a nut which can be locked in a preselected position so that the stop bolt engages and prevents further downward movement of the support arm 14 which forms part of the U-shaped frame 15. FIG. 9 further illustrates a hydraulic control system for the piston and cylinder assembly 22. This control system includes lines 54 and 55 which conduct pressurized hydraulic fluid from a twin non-return check valve 60 which preferably includes a check valve for each of these lines. A magnetically-operable solenoid valve 57 is connected in series with the check valve 60 and receives pressurized hydraulic fluid from the pump 24. An adjustable throttle valve 58 is connected in the feed line 54. In order to move the roller crusher 10 in a downward direction, that is, in a general direction toward the longwall conveyor, the throttle valve 58 connects the associated chamber of the piston and cylinder assembly 22 with the sump 30 by way of the twin non-return valve 60 and solenoid valve 57. FIG. 9 also illustrated a pressure limiting valve 61 for protecting the pump 24 from pressure overloads. The pump received hydraulic fluid from the sump and delivers the fluid to one or the other side of the piston in the piston and cylinder assembly 22, depending upon the setting of the solenoid valve 57. Two pressure switches 62 and 63 are powered by electric line 64 and these switches are connected by lines 65 and 66 in feed line 55 for the piston and cylinder assembly 22. Electrical signals from the pressure switches 62 and 63 are applied by lines 69 and 70, respectively, to electrical actuators 67 and 68 for the solenoid valve 57. The pressure switch 62 is adjusted and constructed to respond to a maximum limit of the fluid pressure in line 55 which may be selected, for example, at less than or equal to 150 bar while the pressure switch 63 is adjusted and constructed to respond to a minimum fluid pressure in line 55 which may be selected at a pressure greater than or equal to 10 bar. In this way, the solenoid valve 57 is controllably positioned and set by pressure of the hydraulic fluid and, in fact, when the pressure of the fluid in line 55 is greater than or equal to 150 bar, the solenoid valve 57 connects the line 65 with the sump 30 and line 54 is connected with the fluid delivery line from the pump 24 so that the roller crusher 10 is lifted in an upward direction. On the other hand, the solenoid valve 57 operates to connect line 55 with the pump and line 54 with the sump whereby the piston and cylinder assembly 22 moves the roller crusher 10 downward and back into its original operating position when the liquid pressure is, for example, at a value greater than or equal 10 bar. According to the hydraulic circuitry illustrated in FIG. 9, the control elements are mounted in a compartment within the drum-type cutting machine.

In the event the drum-type cutting machine is installed for operation at a location which is endangered by the presence of firedamp or methane gas, then the electrically-actuated solenoid valve 57 must be housed within a pressure-tight chamber 71 in order to exclude the possibility of firedamp explosions. This type of chamber is located within the winch housing which includes other electrically-controlled switch valves for the winch drive mechanixm of the mining machine.

Figure 10:
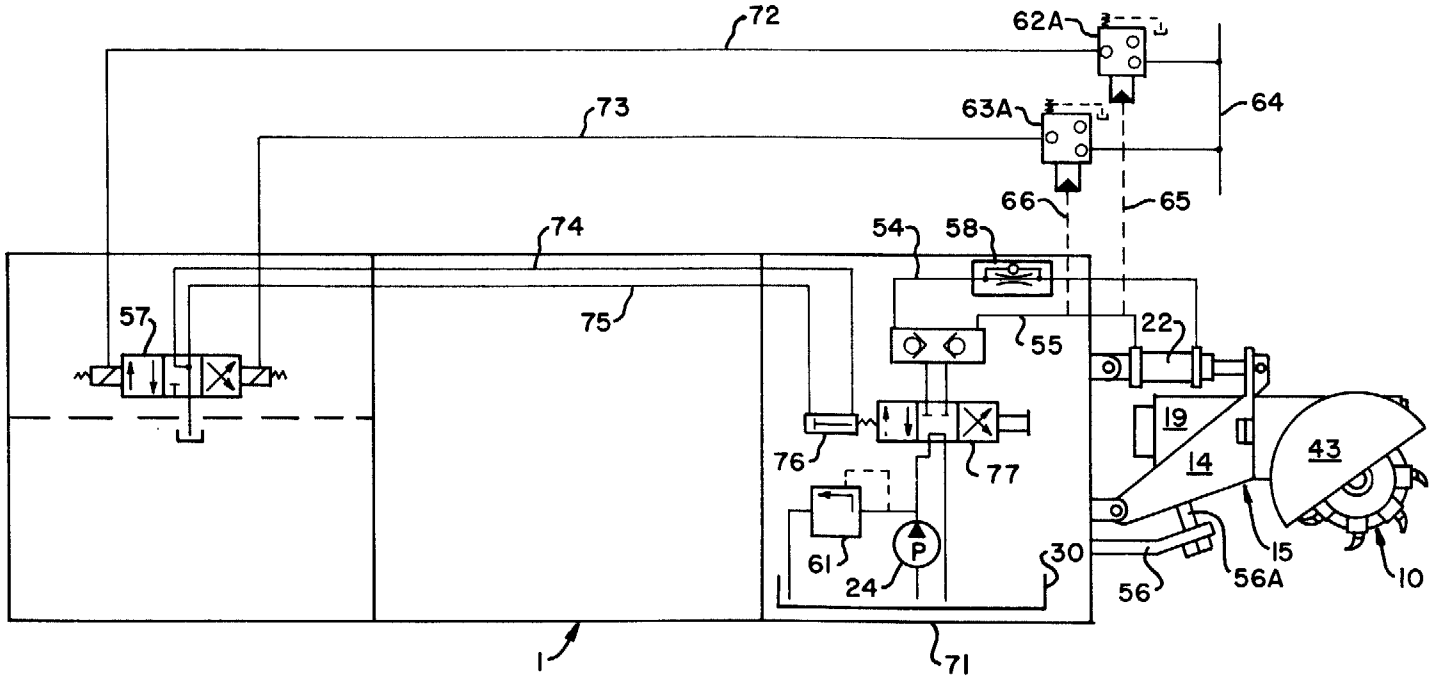
FIG. 10 is a view similar to FIG. 9 and illustrating a further embodiment of the hydraulic control system.

With reference now to FIG. 10, there is illustrated a modified form of hydraulic circuit wherein similar elements of the two embodiments of hydraulic circuits in FIGS. 9 and 10 bear the same reference numerals. The solenoid valve 57 according to the hydraulic circuit of FIG. 10 is also located within winch housing of the mining machine where it is mounted within the pressure-tight chamber 71. The solenoid valve 57 is actuated by intrinsically-safe pressure switches 62A and 63A by way of lines 72 and 73, respectively, so as to provide a flow of hydraulic fluid in the two pipelines 74 and 75 to a control element 76 for the throttle valve 77 located in the drum cutting mining machine. In this way, the support arms 14 of the U-shaped frame are raised under a liquid pressure of less than or equal to 150 bar by means of the piston and cylinder assembly 22 or lowered at a liquid pressure greater than or equal to 10 bar until the arms 14 abut against the adjustable stop 56. As described, the stop sets the limit to the lowermost position of the roller crusher and prevents the roller crusher 10 from unduly restricting the passage of coal carried by the conveyor through the portal opening in the gantry of the mining machine.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. The combination of a conveyor having a support frame adapted to rest upon the footwall of a coal mine and extending in a direction parallel to the working face thereof, and a coal mining apparatus comprising:

a gantry adapted to travel along on said frame and pass above said conveyor, said gantry having a portal opening for the passage of coal therethrough while transported by said conveyor, a coal cutting machine carried by said gantry, a support arm pivotally attached to said machine for movement about a horizontal axis, a cutter head mounted on said support arm for projecting into the working face of the mine, means supported by said coal cutting machine and coupled to said support arm to pivotally displace the support arm about said horizontal axis and thereby selectively position said cutting head into a desired projecting relation toward the working face of the mine.

a roller crusher carried by said coal cutting machine independently of said cutter head at the end of said gantry which faces toward and in a generally overlying relation to the oncoming stream of coal carried by said conveyor, said roller crusher being arranged to break down large lumps of coal on said conveyor before passing into the portal opening in said gantry, a support member rotatably mounting said roller crusher at one end thereof while supported at the other end by said gantry for pivotal movement about a horizontal axis, and a drive motor carried by said support member to rotate only said roller crusher.

2. The combination according to claim 1 further comprising a gear drive including a worm gear secured to the shaft of said drive motor, and a worm wheel in mesh with said worm gear for rotating said roller crusher.

3. The combination according to claim 1 wherein said support member includes a U-shaped frame mounting said drive motor between the opposed side arms thereof.

4. The combination according to claim 3 wherein said coal mining apparatus further includes a hinge pin for attaching said opposed side arms of the U-shaped frame to the end of said coal cutting machine facing toward the oncoming stream of coal on said conveyor.

5. The combination according to claim 3 wherein said coal mining apparatus further includes a piston and cylinder assembly operatively coupled between said U-shaped frame and said coal cutting machine for positioning the former in relation to the oncoming stream of coal on said conveyor.

6. The combination according to claim 5 wherein said coal mining apparatus further includes control means mounted on said coal cutting machine for controlling the passage of pressurized fluid to said piston and cylinder assembly to thereby control the position of said roller crusher relative to said conveyor.

7. The combination according to claim 5 wherein said coal mining apparatus further includes:

fluid conducting lines connected to said piston and cylinder assembly, and valve means for controlling the delivery of fluid by said lines to said piston and cylinder assembly.

8. The combination according to claim 7 wherein said coal mining apparatus further includes, pressure and suction valve means for controlling the passage of fluid from said piston and cylinder assembly.

9. The combination according to claim 7 wherein said coal mining apparatus further comprises:

switch means responsive to a predetermined maximum and a predetermined minimum fluid pressure in the fluid conducting line for providing signals corresponding to the forces urging said roller crusher in a direction away from said conveyor.

10. The combination according to claim 7 wherein said coal mining apparatus further comprises:

means for controlling said valve means in response to the signals from said switch means.

11. The combination according to claim 7 wherein said coal mining apparatus further comprises throttle valve means coupled in at least one of said fluid conducting lines for controlling the speed at which said piston and cylinder assembly displaces said roller crusher relative to said conveyor.

12. The combination according to claim 1 wherein said coal mining apparatus further includes adjustable stop means for limiting the lowermost position of the roller crusher relative to said conveyor.

* * * * *